US008310168B2

(12) United States Patent
Hayashi

(10) Patent No.: US 8,310,168 B2
(45) Date of Patent: Nov. 13, 2012

(54) LIGHT SOURCE DEVICE AND PROJECTOR

(75) Inventor: Katsuhiko Hayashi, Narita (JP)

(73) Assignee: Seiko Epson Corporation, Tokyo (JP)

( * ) Notice: Subject to any disclaimer, the term of this patent is extended or adjusted under 35 U.S.C. 154(b) by 493 days.

(21) Appl. No.: 12/689,564

(22) Filed: Jan. 19, 2010

(65) Prior Publication Data

US 2010/0188010 A1 Jul. 29, 2010

(30) Foreign Application Priority Data

Jan. 29, 2009 (JP) ..... 2009-017704

(51) Int. Cl.
*H05B 41/24* (2006.01)

(52) U.S. Cl. ..... 315/246; 315/39

(58) Field of Classification Search ..... 315/32, 315/39, 246, 248

See application file for complete search history.

(56) References Cited

U.S. PATENT DOCUMENTS

2012/0086352 A1* 4/2012 Espiau et al. ..... 315/248

FOREIGN PATENT DOCUMENTS

JP A-2007-115534 5/2007
JP A-2007-115547 5/2007

* cited by examiner

*Primary Examiner* — Don Le
(74) *Attorney, Agent, or Firm* — Oliff & Berridge, PLC

(57) ABSTRACT

A light source device includes: a microwave power source which outputs a microwave; a light-emitting tube with an emission space where a light-emitting material, which emits light by input of the microwave, is filled; a first electrode which is provided at one side of the light-emitting tube and is electrically connected to the microwave power source; a second electrode which is provided at the other side of the light-emitting tube, the emission space being interposed between the first and second electrodes; and a reflecting plate which is electrically connected to the second electrode and which reflects the microwave such that an antinode of the amplitude of a standing wave of a high-frequency current is positioned in the emission space by making the microwave resonate.

8 Claims, 10 Drawing Sheets

LIGHT SOURCE DEVICE AND PROJECTOR

This application claims priority to Japanese Patent Application No. 2009-017704 filed on Jan. 29, 2009. The entire disclosure of Japanese Patent Application No. 2009-017704 is hereby incorporated herein by reference.

BACKGROUND

1. Technical Field

The present invention relates to a light source device and a projector.

2. Related Art

In recent years, as a light source device used in a projector, an electrodeless discharge lamp using a microwave discharge method is under active development. The electrodeless discharge lamp does not have a discharge electrode in a light-emitting tube unlike known electrode discharge type lamps, such as an incandescent electric lamp and a high-pressure mercury lamp. Accordingly, since consumption of a filament or electrode is suppressed, the electrodeless discharge lamp is expected as a long-life light source.

As the electrodeless discharge lamp, there is a structure of emitting light by making a microwave resonate using the antenna principle and supplying the microwave energy to a light-emitting portion of a lamp. For example, JP-A-2007-115534 and JP-A-2007-115547 disclose that a high impedance portion is formed in a light-emitting portion located in the middle of a light-emitting tube, which has a light-emitting material therein, by making a pair of electrodes protrude into the light-emitting tube and disposing the electrodes opposite each other with a predetermined gap therebetween. In addition, a strong electric field is generated by connecting a power source for microwave generation to one of the pair of electrodes and supplying a microwave to the high impedance portion in the light-emitting tube, such that light is emitted from the light-emitting portion.

However, the technique disclosed in JP-A-2007-115534 and JP-A-2007-115547 adopts a structure of emitting light using the antenna principle. Accordingly, light is emitted from the light-emitting portion and at the same time, a microwave which is supplied leaks to the outside. As a result, the microwave may have an adverse effect on other electronic apparatuses and a human body. Moreover, in a known light source device, the total length of a lamp is a length corresponding to the wavelength of a microwave. For this reason, it may be difficult to make the entire device small. In addition, since impedance matching at the input end is not sufficient in the known light source device, it may be difficult to improve the luminous efficiency.

SUMMARY

An advantage of some aspects of the invention is that it provides a structure capable of improving the luminous efficiency by reducing the leakage of a microwave and making the entire light source device small.

According to an aspect of the invention, there is provided a light source device including: a microwave power source which outputs a microwave; a light-emitting tube with an emission space where a light-emitting material, which emits light by input of the microwave, is filled; a first electrode which is provided at one side of the light-emitting tube and is electrically connected to the microwave power source; a second electrode which is provided at the other side of the light-emitting tube, the emission space being interposed between the first and second electrodes; and a reflecting plate which is electrically connected to the second electrode and which reflects the microwave such that an antinode of the amplitude of a standing wave of a high-frequency current is positioned in the emission space by making the microwave resonate.

According to this configuration, since the reflecting plate is provided, the amplitude of a standing wave of a high-frequency current generated by resonance of a microwave becomes an antinode in the middle of the light-emitting portion and a high-frequency current becomes maximum accordingly, the luminous efficiency can be improved. The inventor of the present application performed simulation of impedance matching at the input end of the light source device according to the aspect of the invention in a state where the frequency of a microwave was set in a range of 1.5 to 4.0 GHz and the length of a supporting portion of the light-emitting tube and the radius of the reflecting plate were adjusted to predetermined lengths under predetermined conditions. As a result, the inventor of the present application confirmed that impedance matching at the input end was realized at a frequency of 2.4 GHz, which was a frequency used in the light source device according to the aspect of the invention, compared with the related art and found out the relationship between the length of the supporting portion and the radius of the reflecting plate at that time. In this case, the length of the supporting portion becomes shorter than that in a known light source by setting the radius of the reflecting plate to a predetermined length. As a result, the total length of a lamp can be shortened. In addition, the inventor of the present application performed the above-described simulation and found out that the radiation ability of a leakage wave was lowered by providing the reflecting plate. Accordingly, it is possible to provide a structure capable of improving the luminous efficiency by reducing a leakage wave and making the entire light source device small.

In the light source device according to the aspect of the invention, it is preferable that the reflecting plate is connected to an end of the second electrode which is opposite to a side of the second electrode provided in the light-emitting tube.

According to this configuration, a standing wave can be generated by causing a microwave output from the microwave power source and a microwave reflected from the reflecting plate to resonate. As a result, since the amplitude of a standing wave of a high-frequency current generated by resonance becomes an antinode in the middle of the light-emitting portion and a high-frequency current becomes maximum accordingly, the luminous efficiency can be improved.

In the light source device according to the aspect of the invention, it is preferable that the reflecting plate is disposed in a direction perpendicular to the longitudinal direction of the second electrode.

The inventor of the present application performed simulation of impedance matching at the input end of the light source device according to the aspect of the invention and found out that the radiation ability of a leakage wave was lowered in the case where the plate was provided in a direction perpendicular to the longitudinal direction of the second electrode more than in the case where the plate was provided in the longitudinal direction of the second electrode. Accordingly, it becomes possible to provide a structure capable of significantly reducing a leakage wave.

In the light source device according to the aspect of the invention, it is preferable that the reflecting plate has a disk-like shape.

According to this configuration, a microwave output from the microwave power source can be reflected efficiently.

In the light source device according to the aspect of the invention, it is preferable that the reflecting plate has a saucer shape.

According to this configuration, light emitted from the light-emitting portion can be condensed and reflected. As a result, high-brightness emission close to a point light source can be realized since light is condensed.

In the light source device according to the aspect of the invention, it is preferable that the reflecting plate is formed of metal.

According to this configuration, since the reflecting plate also functions as a radiator, heat can be efficiently radiated when the heat is generated in the light-emitting portion.

It is preferable that the light source device according to the aspect of the invention further includes a reflector with a reflecting surface which reflects light reflected from the reflecting plate.

According to this configuration, light reflected from the reflecting plate can be efficiently emitted in the approximately fixed direction by means of the reflector.

According to another aspect of the invention, there is provided a projector including the light source device described above.

According to this configuration, since the light source device is provided, a high-performance projector which is excellent in the luminous efficiency can be provided by reducing the leakage of a microwave and making the entire light source device small.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In addition, the embodiments show some aspects of the invention and do not limit the invention, and may be arbitrarily changed within the scope of the technical idea of the invention. Moreover, in the following drawings, the actual structure or the scale of each structure is adjusted so that each configuration is easily recognizable.

First Embodiment

Figure 1A:
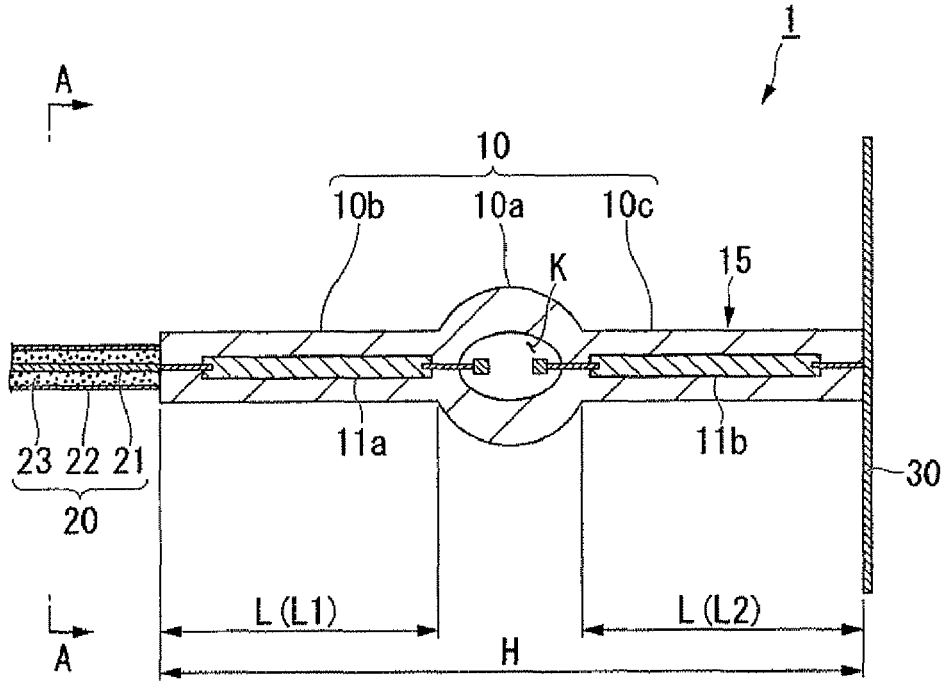
FIGS. 1A and 1B are views showing the schematic configuration of a light source device according to a first embodiment.
Figure 1B:
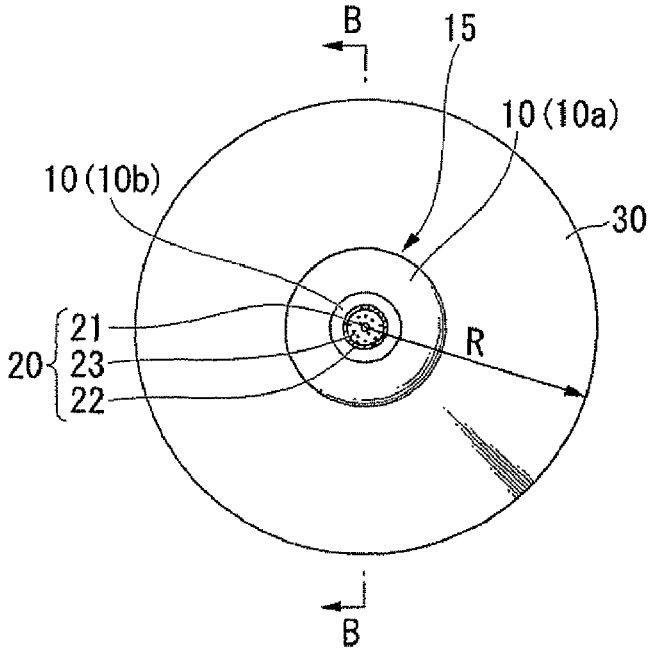

FIGS. 1A and 1B are schematic views showing a light source device according to a first embodiment of the invention. FIG. 1A is a sectional view taken along the line IA-IA of FIG. 1B. FIG. 1B is a sectional view taken along the line IB-IB of FIG. 1A. As shown in FIGS. 1A and 1B, a light source device 1 according to the present embodiment includes a microwave excitation lamp 15, a reflecting plate 30 connected to one side of the microwave excitation lamp 15, and a coaxial cable 20 connected to the other side of the microwave excitation lamp 15. A microwave power source (not shown) which outputs a microwave is connected to a side of the coaxial cable 20 which is opposite to the other side of the coaxial cable 20 connected to the microwave excitation lamp 15. The microwave excitation lamp 15 emits light by a microwave which is input from the microwave power source through the coaxial cable 20.

The microwave excitation lamp 15 includes a light-emitting tube 10 and a pair of electrodes 11*a* (first electrode) and 11*b* (second electrode) disposed in the light-emitting tube 10. The light-emitting tube 10 has a light-emitting portion 10*a* which expands spherically in the middle and supporting portions 10*b* and 10*c* which have thin tube shapes and extend from both sides of the light-emitting portion 10*a*. The light-emitting tube 10 is formed of an insulating material, such as quartz glass.

A light-emitting material which emits light by input of a microwave is filled in an emission space K formed in the light-emitting portion 10*a*. For example, mercury, rare gas, or halogen compound may be used as the light-emitting material. In addition, by enclosing the light-emitting material with very high pressure, a sufficient luminance can be obtained by excitation of a microwave.

The first electrode 11*a* is inserted in the supporting portion 10*b* and is electrically connected to the microwave power source via the coaxial cable 20. On the other hand, the second electrode 11*b* is inserted in the supporting portion 10*c*. The electrodes 11*a* and 11*b* are disposed with a predetermined gap therebetween such that tips of the electrodes 11*a* and 11*b* are opposite each other in the emission space K of the light-emitting portion 10*a*. In addition, it is preferable that the gap between the tips of the electrodes 11*a* and 11*b* is as small as possible. Thus, high-brightness emission close to a point light source can be realized. A conductive material which has a small coefficient of thermal expansion and high thermal resistance, for example, tungsten, may be used as a material of forming the electrodes 11*a* and 11*b*.

The reflecting plate 30 has a disk-like shape and is connected to the other end of the second electrode 11*b* which is opposite to the side of the second electrode 11*b* provided in the supporting portion 10. In addition, the reflecting plate 30 is disposed at the position overlapping the coaxial cable 20 and the light-emitting portion 10*a* in the sectional view of FIG. 1B. Accordingly, a microwave output from the microwave power source can be reflected efficiently. In addition, a standing wave can be generated by causing a microwave output from the microwave power source and a microwave reflected from the reflecting plate 30 to resonate. As a material of forming the reflecting plate 30, it is possible to use a metal, such as aluminum. In this case, the reflecting plate 30 also functions as a radiator. Accordingly, when heat is generated in the light-emitting portion 10*a*, the heat can be efficiently radiated.

The coaxial cable 20 includes an inner conductor 21, an outer conductor 22 which covers the inner conductor 21, and a dielectric 23 interposed between the inner conductor 21 and the outer conductor 22. As a material of forming the inner conductor 21 and the outer conductor 22, copper may be used, for example. As a material of forming the dielectric 23, PTFE (polytetrafluoroethylene) with little dielectric loss for a microwave is used, for example. In addition, it is preferable to keep the characteristic impedance of the coaxial cable 20 50Ω. In this case, a high-frequency signal (microwave) can be efficiently supplied to the light-emitting portion 10*a* without a loss in signal transmission.

Next, the dimensions shown in FIGS. 1A and 1B will be described. The dimension H is a distance (hereinafter, referred to as a total length of a lamp) of the microwave excitation lamp 15 in the longitudinal direction. The dimension. L is a distance (hereinafter, referred to as a length of a supporting portion) of each of the supporting portions 10*b* and 10*c* in the longitudinal direction. In addition, the dimension R is a radius of the reflecting plate 30.

Of the length L of the supporting portion, the dimension L1 is a length of the supporting portion 10*b* and the dimension L2 is a length of the supporting portion 10*c*. In addition, the lengths L1 and L2 are approximately the same. Accordingly, since the light-emitting tube 10 has the same shape in the left and right directions, it is not necessary to match the left and right directions of the light-emitting tube 10. As a result, the manufacturing efficiency can be improved.

In addition, the inventor of the present application performed simulation of impedance matching at the input end of the light source device 1 according to the embodiment of the invention in a state where the frequency of a microwave was set in a range of 1.5 to 4.0 GHz and the length L of the supporting portion of the light-emitting tube 10 and the radius R of the reflecting plate were adjusted to predetermined lengths under predetermined conditions. As a result, the inventor of the present application confirmed that impedance matching at the input end was realized at a frequency of 2.4 GHz, which was a frequency used in the light source device 1 according to the present embodiment, compared with the related art and found out the relationship between the length L of the supporting portion and the radius R of the reflecting plate at that time. In this case, the length L of the supporting portion becomes shorter than that in a known light source device 1000 (FIG. 13) by setting the radius R of the reflecting plate to a predetermined length. As a result, the total length H of the lamp can be shortened.

Figure 13:
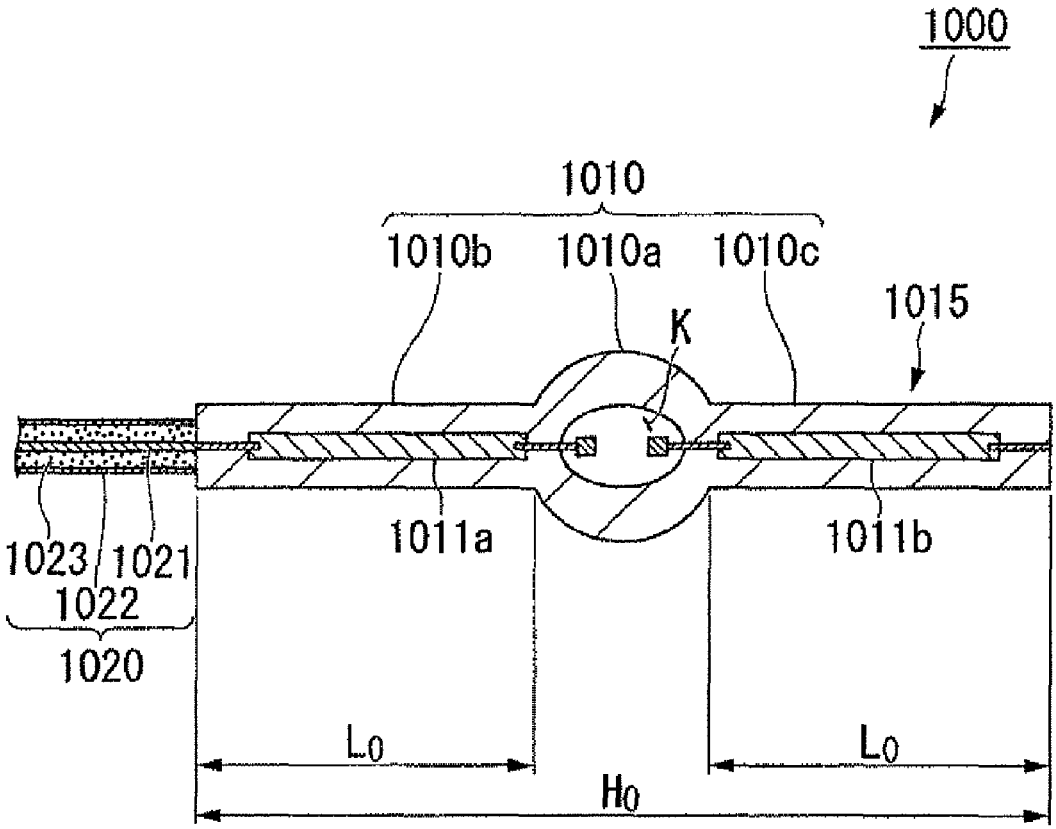
FIG. 13 is a sectional view showing the schematic configuration of a known light source device.

Here, a known light source device will be described. FIG. 13 is a schematic view showing the known light source device 1000. FIG. 13 is a view showing the sectional configuration of the known light source device 1000 and corresponds to FIG. 1A. The same components as in FIG. 1A are denoted by the same reference numerals, and a detailed explanation thereof will not be repeated.

As shown in FIG. 13, the light source device 1000 includes a microwave excitation lamp 1015 and a coaxial cable 1020 connected to one side of the microwave excitation lamp 1015. Reference numeral 1010 indicates a light-emitting tube, reference numeral 1010*a* indicates a light-emitting portion, reference numerals 1010*b* and 1010*c* indicate supporting portions, reference numerals 1011*a* and 1011*b* indicate electrodes, reference numeral 1021 indicates an inner conductor, reference numeral 1022 indicates an outer conductor, and reference numeral 1023 indicates a dielectric. The dimension $H_0$ is a total length of the microwave excitation lamp 1015, the dimension $L_0$ is a length of each of the supporting portions 1010*b* and 1010*c*. The known light source device 1000 is different from the light source device 1 according to the present embodiment in that the reflecting plate 30 is not provided.

In the light source device 1000, a high impedance portion is formed in a light-emitting portion 1010*a* using the antenna principle by making the pair of electrodes 1011*a* and 1011*b* protrude into the emission space K and disposing the pair of electrodes 1011*a* and 1011*b* opposite each other with a predetermined gap therebetween. In addition, the total length $H_0$ of a lamp of the light source device 1000 is a length of about ½ of the effective wavelength of a microwave. That is, assuming that the effective wavelength of a microwave is λ, the total length $H_0$ of the lamp satisfies "$H_0=n\lambda/2$, where n is an odd number". For this reason, the occupied volume of the light source device 1000 increases when the light source device 1000 is actually mounted in an optical apparatus, such as a projector. Accordingly, it has been difficult to realize miniaturization.

Figure 14:
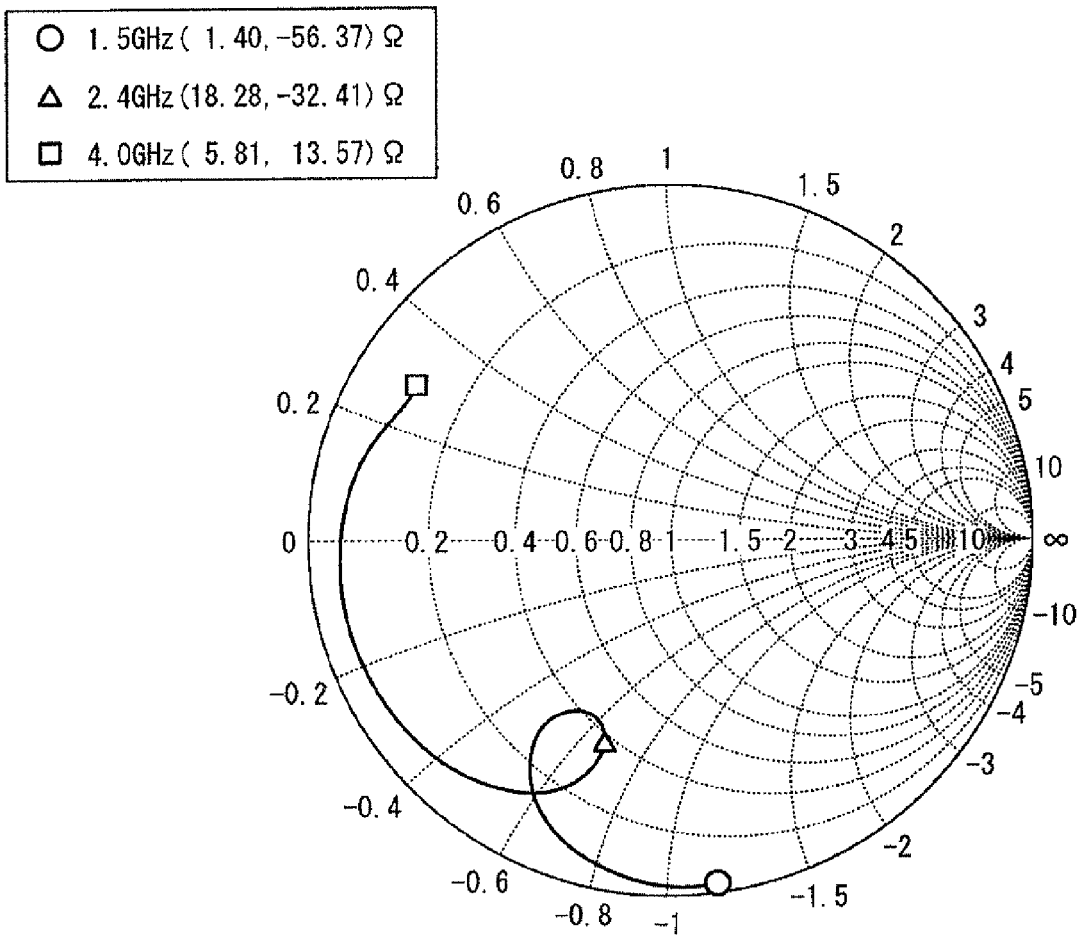
FIG. 14 shows a Smith chart of the known light source device.

Next, a result of the simulation of impedance matching at the input end of the light source device 1000 that the inventor of the present application performed with the known light source device 1000 will be described. FIG. 14 is a view showing the Smith chart (impedance chart) of the known light source device 1000. In addition, the simulation conditions (various parameters) are as follows. The relative permittivity is 80+30j, the simulation method is limited integration, the boundary condition of simulation space is a complete absorption boundary, the frequency is 1.5 to 4.0 GHz, and the signal input is an input using a coaxial line of 50Ω. In addition, the frequency is in a range of 1.5 to 4.0 GHz. In addition, the total length $H_0$ of the lamp is set to 42.6 mm and the length $L_0$ of the supporting portion is set to 18 mm.

An impedance of the input end of the light source device is expressed as R±jX (real number+imaginary number). As the coordinates of the impedance plotted on the Smith chart in FIG. 14 become closer to the normalized impedance of 1Ω at the center, impedance matching at the input end of the light source device is improved (impedance matching is performed). On the other hand, impedance matching is not performed at the outer peripheral side (periphery side) in FIG. 14. Accordingly, a microwave is reflected without being input to the light source device.

A symbol ○ in FIG. 14 indicates the coordinates (1.40, −56.37) of the impedance of the input end of the light source device 1000 at a frequency of 1.5 GHz. In this case, the reference is 50Ω. Accordingly, 0.03 is obtained by dividing 1.40 of R part by 50 of the reference and normalizing it and 1.13 is obtained by similarly normalizing 56.37 of j part, such that each of the coordinate is calculated. Accordingly, an intersection of 0.03 on the horizontal axis and 1.13 on the minus side (under the horizontal axis) becomes the coordinates of the normalized impedance of the input end of the light source device 1000 at a frequency of 1.5 GHz.

In addition, a symbol Δ in FIG. 14 indicates the coordinates (18.28, −32.41) of the impedance of the input end at a frequency of 2.4 GHz which is a frequency used in the light source device 1000. After normalization, the coordinate of R part becomes 0.37 and the coordinate of j part becomes 0.65. Accordingly, an intersection of 0.37 on the horizontal axis and 0.65 on the minus side (under the horizontal axis) becomes the coordinates of the normalized impedance of the input end of the light source device 1000 at a frequency of 2.4 GHz.

In addition, a symbol □ in FIG. 14 indicates the coordinates (5.81, 13.57) of the impedance of the input end of the light source device 1000 at a frequency of 4.0 GHz. After normalization, the coordinate of R part becomes 0.12 and the coordinate of j part becomes 0.27. Accordingly, an intersection of 0.12 on the horizontal axis and 0.27 on the plus side (above the horizontal axis) becomes the coordinates of the normalized impedance of the input end of the light source device 1000 at a frequency of 4.0 GHz.

A solid line in FIG. 14 indicates the locus of the impedance of the input end of the light source device 1000 in a frequency range of 1.5 to 4.0 GHz. As shown in FIG. 14, in a frequency range of 1.5 to 2.4 GHz, the impedance changes from capacitive to inductive and is shifted toward 1Ω at the center of the circle as the frequency increases (○→Δ in FIG. 14). On the other hand, in a frequency range of 2.4 to 4.0 GHz, the impedance becomes distant from the center of the circle and moves along the outer periphery of the circle from the center as the frequency increases (Δ→□ in FIG. 14).

However, when viewing the coordinate (Δ in FIG. 14) at a frequency of 2.4 GHz, which is a frequency used in the light source device 1000, from the center of the circle of the Smith chart, it is confirmed that there is no closer coordinate (it cannot be said that impedance matching at the input end of the light source device 1000 is improved). Thus, since impedance matching at the input end is not sufficient in the known light source device, it has been difficult to improve the luminous efficiency.

Therefore, the inventor of the present application found out the relationship between the length L of the supporting portion and the radius R of the reflecting plate, which is conditions under which the entire light source device can be made small and the luminous efficiency can be improved accordingly (conditions under which impedance matching at the input end is realized), by providing the reflecting plate 30 at one side of the microwave excitation lamp 1015 of the light source device 1000 in the related art.

Figure 2:
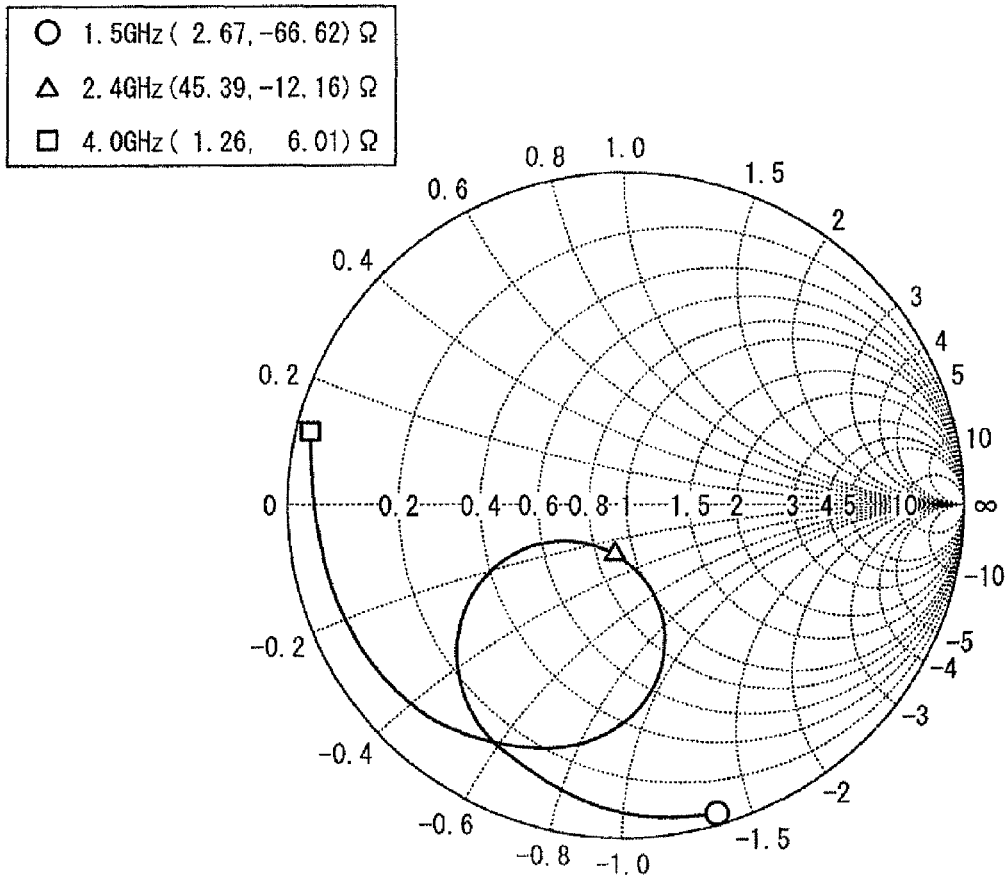
FIG. 2 shows a Smith chart of the light source device according to the first embodiment.

Next, a result of the simulation of impedance matching at the input end that the inventor of the present application performed with the light source device 1 according to the present embodiment will be described. FIG. 2 is a view showing the Smith chart (impedance chart) of the light source device 1 and corresponds to FIG. 14. The same components as in FIG. 14 are denoted by the same reference numerals, and a detailed explanation thereof will not be repeated. In addition, in this simulation, the total length H of a lamp is set to 16.6 m, the length L of a supporting portion is set to 5.3 mm, and the radius R of a reflecting plate is set to 24 mm.

A symbol ○ in FIG. 2 indicates the coordinates (2.67, −66.62) of the impedance of the input end of the light source device 1 at a frequency of 1.5 GHz. After normalization, the coordinate of R part becomes 0.05 and the coordinate of j part becomes 1.33. Accordingly, an intersection of 0.05 on the horizontal axis and 1.33 on the minus side (under the horizontal axis) becomes the coordinates of the normalized impedance of the input end of the light source device 1 at a frequency of 1.5 GHz.

In addition, a symbol Δ in FIG. 2 indicates the coordinates (45.39, −12.16) of the impedance of the input end at a frequency of 2.4 GHz which is a frequency used in the light source device 1 according to the present embodiment. After normalization, the coordinate of R part becomes 0.91 and the coordinate of j part becomes 0.24. Accordingly, an intersection of 0.91 on the horizontal axis and 0.24 on the minus side (under the horizontal axis) becomes the coordinates of the normalized impedance of the input end of the light source device 1 at a frequency of 2.4 GHz.

In addition, a symbol □ in FIG. 2 indicates the coordinates (1.26, 6.01) of the impedance of the input end of the light source device 1 at a frequency of 4.0 GHz. After normalization, the coordinate of R part becomes 0.03 and the coordinate of j part becomes 0.12. Accordingly, an intersection of 0.03 on the horizontal axis and 0.12 on the plus side (above the horizontal axis) becomes the coordinates of the normalized impedance of the input end of the light source device 1 at a frequency of 4.0 GHz.

A solid line in FIG. 2 indicates the locus of the impedance of the input end of the light source device 1 in a frequency range of 1.5 to 4.0 GHz. As shown in FIG. 2, in a frequency range of 1.5 to 2.4 GHz, the impedance changes from capacitive to inductive and is shifted toward 1Ω at the center of the circle as the frequency increases (○→Δ in FIG. 2). On the other hand, in a frequency range of 2.4 to 4.0 GHz, the impedance becomes distant from the center of the circle and moves along the outer periphery of the circle from the center as the frequency increases (Δ→□ in FIG. 2).

When FIG. 2 is compared with FIG. 14 (Smith chart of the known light source device), the coordinate (Δ in FIG. 2) at a frequency of 2.4 GHz in FIG. 2 is closer to 1Ω at the center of the circle than in FIG. 14. That is, when viewing the coordinate (Δ in FIG. 2) at a frequency of 2.4 GHz from the center of the circle of the Smith chart, it is confirmed that the j part can be reduced and the R part can be made close to 50Ω (1Ω) (impedance matching at the input end is improved) compared with that in the related art. Therefore, also from the Smith chart, it is confirmed that the luminous efficiency can be improved in the light source device 1 according to the present embodiment since impedance matching at the input end at a frequency of 2.4 GHz is improved, compared with the known light source device 1000.

Figure 3:
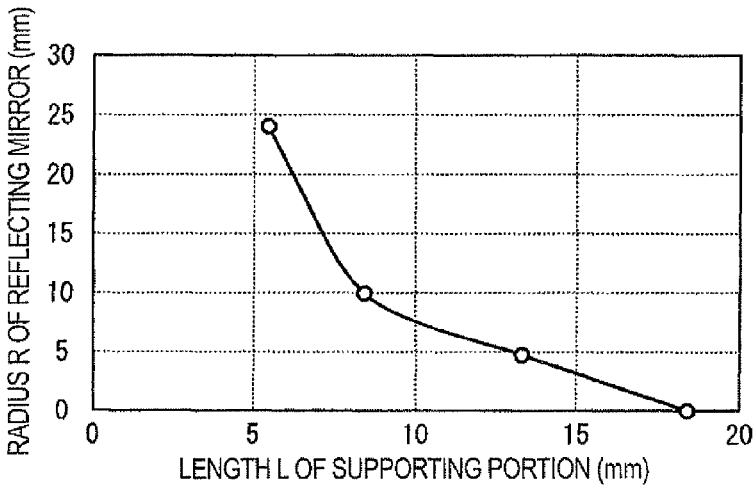
FIG. 3 is a view showing the relationship between the length of a supporting portion and the radius of a reflecting plate in the light source device according to the first embodiment.

Next, the relationship between the length L of the supporting portion and the radius R of the reflecting plate when impedance matching at the input end at a frequency of 2.4 GHz is performed in the light source device 1 according to the present embodiment will be described. FIG. 3 is a view showing the relationship between the length L of the supporting portion and the radius R of the reflecting plate. In FIG. 3, the horizontal axis indicates the length L (mm) of the supporting portion, and the vertical axis indicates the radius R (mm) of the reflecting plate. In addition, the length L of the supporting portion indicates the length of one of the supporting portions 10*b* and 10*c*. In other words, the length L of the supporting portion indicates one of the lengths L1 and L2 of the supporting portions. In the present embodiment, the lengths L1 and L2 of the supporting portions are approximately the same.

A solid line in FIG. 3 starts from the point (known light source device) where there is no reflecting plate and shows a change in the length of the supporting portion when the radius R of the reflecting plate is increased by providing a reflecting plate. As shown in FIG. 3, in a range from the point where there is no reflecting plate to the point where the radius R of the reflecting plate is 24 mm, the length L of the supporting portion decreases as the radius R of the reflecting plate increases. In the range from the point where there is no reflecting plate to the point where the radius R of the reflecting plate is 24 mm, the length L of the supporting portion is smallest when the radius R of the reflecting plate is 24 mm. When the radius R of the reflecting plate is 24 mm, the length L of the supporting portion is 5.3 mm.

In addition, the total length H of the lamp of the light source device 1 according to the present embodiment is 16.6 mm. That is, the total length H of the lamp of the light source device 1 according to the present embodiment is reduced to about 40% of 42.6 mm which is the total length $H_0$ of the lamp of the known light source device 1000. Accordingly, also from the relationship between the total length of the lamp of the light source device 1 according to the present embodiment and the total length of the lamp of the known light source device 1000, it is confirmed that the entire light source device 1 according to the present embodiment can be made smaller than the known light source device 1000.

In addition, the inventor of the present application performed the above-described simulation and found out that the radiation ability of a leakage wave was lowered by providing a reflecting plate. It was confirmed that the radiation ability of a leakage wave of the light source device 1 according to the present embodiment was about 70% of that of the known light source device 1000. Accordingly, the light source device according to the present embodiment can reduce a leakage wave compared with the known light source device 1000.

According to the light source device 1 of the present embodiment, since the reflecting plate 30 is provided, the amplitude of a standing wave of a high-frequency current generated by resonance of a microwave becomes an antinode in the middle of the light-emitting portion 10*a* and a high-frequency current becomes maximum accordingly. As a result, the luminous efficiency can be improved. The inventor of the present application performed simulation of impedance matching at the input end of the light source device 1 in a state where the frequency of a microwave was set in a range of 1.5 to 4.0 GHz and the length L of the supporting portion of the light-emitting tube 10 and the radius R of the reflecting plate were adjusted to predetermined lengths under predetermined conditions. As a result, the inventor of the present application confirmed that impedance matching at the input end of the light source device 1 was realized at a frequency of 2.4 GHz compared with the related art and found out the relationship between the length L of the supporting portion and the radius R of the reflecting plate at that time. In this case, the length L of the supporting portion becomes shorter than that in the known light source device 1000 by setting the radius R of the reflecting plate to a predetermined length. As a result, the total length H of the lamp can be shortened. In addition, the inventor of the present application performed the above-described simulation and found out that the radiation ability of a leakage wave was lowered by providing the reflecting plate 30. Accordingly, it is possible to provide a structure capable of improving the luminous efficiency by reducing a leakage wave and making the entire light source device small.

In addition, according to this configuration, the reflecting plate 30 is connected to an end of the second electrode 11*b* which is opposite to the side of the second electrode 11*b* provided in the supporting portion 10. Accordingly, a standing wave can be generated by causing a microwave output from the microwave power source and a microwave reflected from the reflecting plate 30 to resonate. As a result, since the amplitude of a standing wave of a high-frequency current generated by resonance becomes an antinode in the middle of the light-emitting portion 10*a* and a high-frequency current becomes maximum accordingly, the luminous efficiency can be improved.

Moreover, according to the above configuration, since the reflecting plate 30 has a disk-like shape, a microwave output from the microwave power source can be efficiently reflected.

Moreover, according to the above configuration, since the reflecting plate 30 is formed of metal, the reflecting plate 30 also functions as a radiator. Accordingly, when heat is generated in the light-emitting portion 10*a*, the heat can be efficiently radiated.

Second Embodiment

Figure 4:
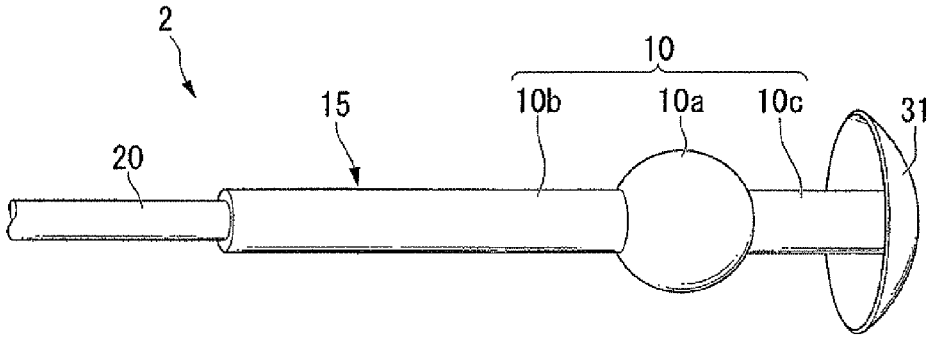
FIG. 4 is a view showing the schematic configuration of a light source device according to a second embodiment.

Next, a light source device according to a second embodiment of the invention will be described with reference to FIG. 4. FIG. 4 is a view showing the schematic configuration of a light source device 2. The light source device 2 according to the present embodiment is different from the light source device 1 described in the first embodiment in that a reflecting plate 31 has a saucer shape. The other points are the same as those in the first embodiment. Accordingly, the same components as in FIGS. 1A and 1B are denoted by the same reference numerals, and a detailed explanation thereof will not be repeated.

As shown in FIG. 4, in the light source device 2, the reflecting plate 31 has a saucer shape instead of the disk-like shape unlike the light source device 1 of the first embodiment. One side of the microwave excitation lamp 15, specifically, an end of the supporting portion 10*c* which is opposite to a side of the supporting portion 10*c* adjacent to the light-emitting portion 10*a* is connected to the middle of a recess of the saucer-shaped reflecting plate 31.

According to the light source device 2 of the present embodiment, since the reflecting plate 31 has a saucer shape, light emitted from the light-emitting portion 10*a* can be condensed and reflected. As a result, high-brightness emission close to a point light source can be realized since light is condensed.

Third Embodiment

Figure 5:
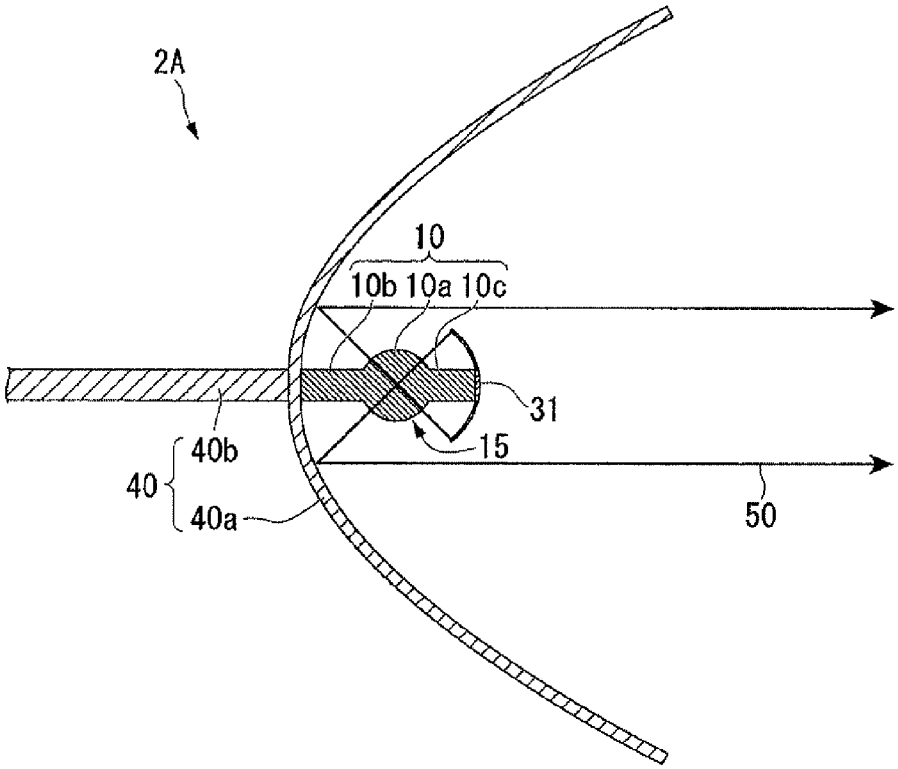
FIG. 5 is a sectional view showing the schematic configuration of a light source device according to a third embodiment.

Next, a light source device according to a third embodiment of the invention will be described with reference to FIG. 5. FIG. 5 is a view showing the sectional configuration of a light source device 2A obtained by providing a reflector 40 in the light source device 2. The light source device 2A according to the present embodiment is different from the light source device 2 described in the second embodiment in that the reflector 40 is provided. The other points are the same as those in the second embodiment. Accordingly, the same components as in FIG. 4 are denoted by the same reference numerals, and a detailed explanation thereof will not be repeated.

As shown in FIG. 5, the light source device 2A is formed by providing the reflector 40, which reflects light emitted from the light-emitting portion 10*a* and light reflected from the reflecting plate 31, in the light source device 2 of the second embodiment. The reflector 40 includes an insertion portion 40*b*, into which the microwave excitation lamp 15 is inserted, and a reflecting portion 40*a*, which has a parabolic reflecting surface that spreads from the insertion portion 40*b*. As a material of forming the reflector 40, quartz glass is used, for example. The insertion portion 40*b* and the reflecting portion 40*a* are integrally formed. On the reflecting surface of the reflecting portion 40*a*, a dielectric multilayer which transmits a microwave and reflects light emitted from the light-emitting portion 10*a* and light reflected from the reflecting plate 31 is formed. Accordingly, the emission direction of light 50 reflected by the reflector 40 becomes approximately fixed.

According to the light source device 2A of the present embodiment, the reflector 40 which has a reflecting surface that reflects light reflected from the reflecting plate 31 is provided. Accordingly, light emitted from the light-emitting portion 10*a* and light reflected from the reflecting plate 31 can be efficiently emitted in the approximately fixed direction by means of the reflector 40.

Fourth Embodiment

Figure 6A:
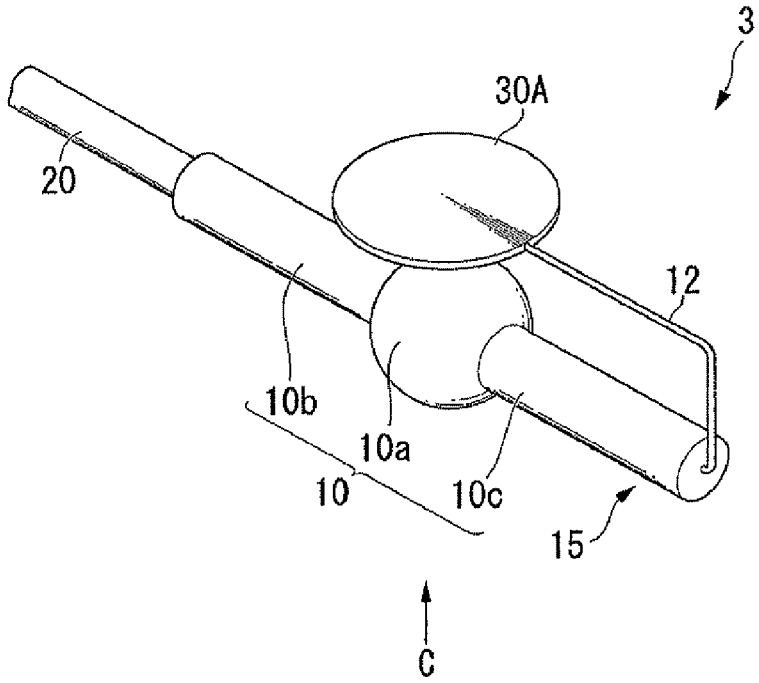
FIGS. 6A and 6B are views showing the schematic configuration of a light source device according to a fourth embodiment.
Figure 6B:
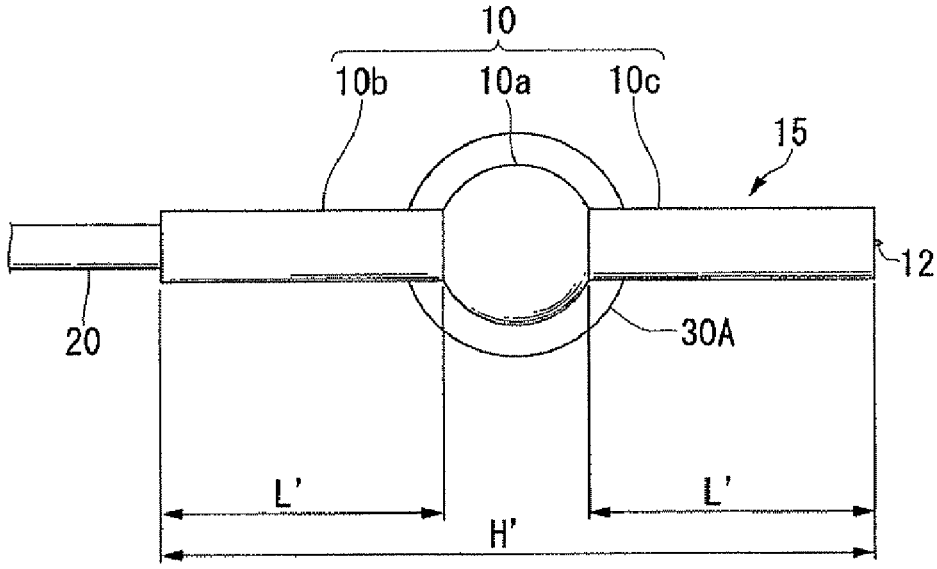

Next, a light source device according to a fourth embodiment of the invention will be described with reference to FIGS. 6A and 6B. FIG. 6A is a perspective view showing the schematic configuration of a light source device 3. FIG. 6B is a bottom view seen from the arrow C of FIG. 6A. The light source device 3 according to the present embodiment is different from the light source device 1 described in the first embodiment in that a reflecting plate 30A is disposed in a direction perpendicular to the longitudinal direction of the supporting portion 10*c* (longitudinal direction of the second electrode 11*b*). The other points are the same as those in the first embodiment. Accordingly, the same components as in FIGS. 1A and 1B are denoted by the same reference numerals, and a detailed explanation thereof will not be repeated.

As shown in FIGS. 6A and 6B, in the light source device 3, the reflecting plate 30A is disposed in a direction perpendicular to the longitudinal direction of the supporting portion 10*c* (longitudinal direction of the second electrode 11*b*) unlike the light source device 1 of the first embodiment. Specifically, the reflecting plate 30A is electrically connected to the second electrode 11*b*, which is provided in the microwave excitation lamp 15, through a conductive member 12 which is bent in the L shape. In addition, the reflecting plate 30A is disposed at the position overlapping the light-emitting portion 10*a* in the bottom view shown in FIG. 6B. In other words, the reflecting plate 30A is disposed at the position facing a side surface of the light-emitting portion 10*a* adjacent to the sides where the supporting portions 10*b* and 10*c* are provided. The conductive member 12 is connected to a side surface of the disk-like reflecting plate 30A. The dimension H' is a total length of the microwave excitation lamp 15, the dimension L' is a length of each of the supporting portions 10*b* and 10*c*.

In addition, the inventor of the present application performed simulation of impedance matching at the input end of the light source device 3 according to the present embodiment in the same manner as in the light source device 1 of the first embodiment. As a result, the inventor of the present application found out that the total length of a lamp in the light source device 3 could be made shorter than that in the known light source device 1000, similar to the light source device 1 of the first embodiment. In addition, the inventor of the present application performed the above-described simulation and found out that the radiation ability of a leakage wave was lowered in the light source device 3 more than that in the light source device 1 of the first embodiment. Hereinafter, a result of the simulation of impedance matching at the input end that the inventor of the present application performed with the light source device 3 according to the present embodiment of the invention will be described.

Figure 7:
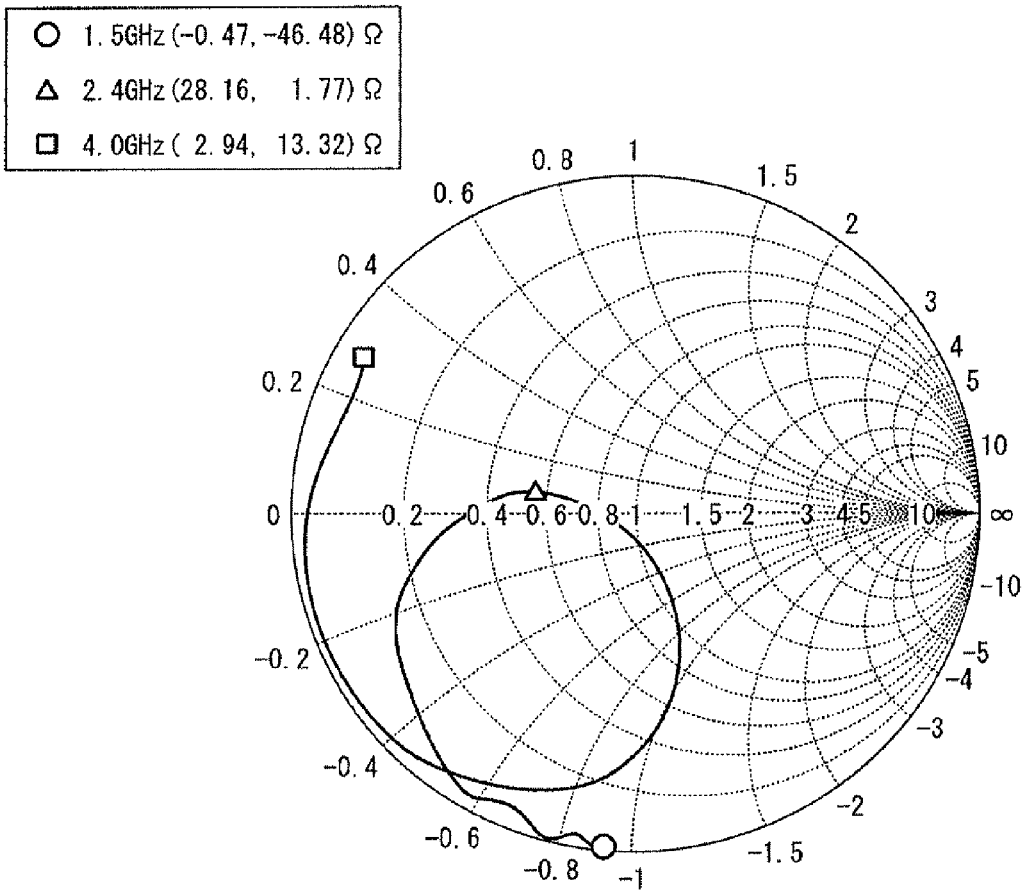
FIG. 7 shows a Smith chart of the light source device according to the fourth embodiment.

FIG. 7 is a view showing the Smith chart (impedance chart) of the light source device 3 and corresponds to FIG. 14. The same components as in FIG. 14 are denoted by the same reference numerals, and a detailed explanation thereof will not be repeated. In addition, in this simulation, the total length H' of a lamp is set to 16.6 mm, the length L' of a supporting portion is set to 5.3 mm, and the radius R' of a reflecting plate is set to 7 mm.

A symbol ○ in FIG. 7 indicates the coordinates (−0.47, −46.48) of the impedance of the input end of the light source device 3 at a frequency of 1.5 GHz. After normalization, the coordinate of R part becomes 0.01 and the coordinate of j part becomes 0.93. Accordingly, an intersection of 0.01 on the horizontal axis and 0.93 on the minus side (under the horizontal axis) becomes the coordinates of the normalized impedance of the input end of the light source device 3 at a frequency of 1.5 GHz.

In addition, a symbol Δ in FIG. 7 indicates the coordinates (28.16, 1.77) of the impedance of the input end of the light source device 3 at a frequency of 2.4 GHz which is a frequency used in the light source device 3. After normalization, the coordinate of R part becomes 0.56 and the coordinate of j part becomes 0.04. Accordingly, an intersection of 0.56 on the horizontal axis and 0.04 on the plus side (above the horizontal axis) becomes the coordinates of the normalized impedance of the input end of the light source device 3 at a frequency of 2.4 GHz.

In addition, a symbol □ in FIG. 7 indicates the coordinates (2.94, 13.32) of the impedance of the input end of the light source device 3 at a frequency of 4.0 GHz. After normalization, the coordinate of R part becomes 0.06 and the coordinate of j part becomes 0.27. Accordingly, an intersection of 0.06 on the horizontal axis and 0.27 on the plus side (above the horizontal axis) becomes the coordinates of the normalized impedance of the input end of the light source device 3 at a frequency of 4.0 GHz.

A solid line in FIG. 7 indicates the locus of the impedance in a frequency range of 1.5 to 4.0 GHz. As shown in FIG. 7, in a frequency range of 1.5 to 2.4 GHz, the impedance changes from capacitive to inductive and is shifted toward 1Ω at the center of the circle as the frequency increases (○→Δ in FIG. 7). On the other hand, in a frequency range of 2.4 to 4.0 GHz, the impedance becomes distant from the center of the circle and moves along the outer periphery of the circle from the center as the frequency increases (Δ→□ in FIG. 7).

When FIG. 7 is compared with FIG. 14 (Smith chart of the known light source device), the coordinate (Δ in FIG. 7) at a frequency of 2.4 GHz, which is a frequency used in the light source device 3, in FIG. 7 is closer to 1Ω at the center of the circle than in FIG. 14. That is, when viewing the coordinate (Δ in FIG. 7) at a frequency of 2.4 GHz from the center of the circle of the Smith chart, it is confirmed that the j part can be reduced and the R part can be made close to 50Ω (1Ω) (impedance matching is improved) compared with that in the related art. Therefore, also from the Smith chart, it is confirmed that the luminous efficiency can be improved in the light source device 3 according to the present embodiment since impedance matching at the input end at a frequency of 2.4 GHz is improved compared with the known light source device 1000, similar to the light source device 1 of the first embodiment.

Figure 8:
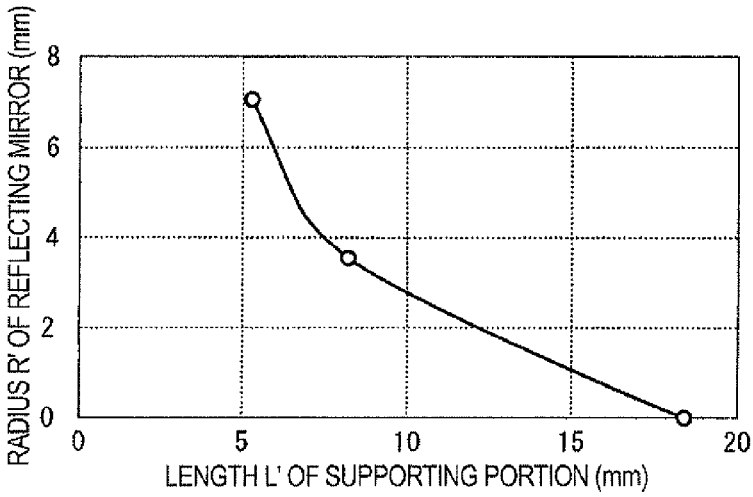
FIG. 8 is a view showing the relationship between the length of a supporting portion and the radius of a reflecting plate in the light source device according to the fourth embodiment.

Next, the relationship between the length L of the supporting portion and the radius R of the reflecting plate when impedance matching at the input end at a frequency of 2.4 GHz is performed in the light source device 3 according to the present embodiment will be described. FIG. 8 is a view showing the relationship between the length L' of the supporting portion and the radius R' of the reflecting plate. In FIG. 8, the horizontal axis indicates the length L' (mm) of the supporting portion, and the vertical axis indicates the radius R' (mm) of the reflecting plate.

A solid line in FIG. 8 starts from the point (known light source device) where there is no reflecting plate and shows a change in the length of the supporting portion when the radius R' of the reflecting plate is increased by providing the reflecting plate 30A. As shown in FIG. 8, in a range from the point where there is no reflecting plate to the point where the radius R' of the reflecting plate is 7 mm, the length L' of the supporting portion decreases as the radius R' of the reflecting plate increases. In the range from the point where there is no reflecting plate to the point where the radius R' of the reflecting plate is 7 mm, the length L' of the supporting portion is smallest when the radius R' of the reflecting plate is 7 mm. When the radius R' of the reflecting plate is 7 mm, the length L' of the supporting portion is 5.3 mm.

In addition, the total length H' of the lamp of the light source device 3 according to the present embodiment is 16.6 mm. That is, the total length H of the lamp of the light source device 3 according to the present embodiment is reduced to about 40% of 42.6 mm which is the total length $H_0$ of the lamp of the known light source device 1000. Accordingly, also from the relationship between the total length of the lamp of the light source device 3 according to the present embodiment and the total length of the lamp of the known light source device 1000, it is confirmed that the entire light source device 3 according to the present embodiment can be made smaller than the known light source device 1000, similar to the light source device 1 of the first embodiment. In addition, the radius R' of the reflecting plate of the light source device 3 according to the present embodiment is 7 mm. That is, the radius R' of the reflecting plate of the light source device 3 according to the present embodiment is reduced to about 30% of 24 mm which is the radius R of the reflecting plate of the light source device 1 of the first embodiment. Accordingly, it is confirmed that the entire light source device 3 according to the present embodiment can be made smaller than the light source device 1 of the first embodiment.

In addition, the inventor of the present application performed the above-described simulation and found out that the radiation ability of a leakage wave was lowered more than that in the light source device 1 of the first embodiment by providing the reflecting plate 30A. It was confirmed that the radiation ability of a leakage wave of the light source device 3 according to the present embodiment was about 35% of that of the known light source device 1000. Since the radiation ability of a leakage wave of the light source device 1 of the first embodiment is about 70% of that of the known light source device 1000, it can be seen that the radiation ability of a leakage wave of the light source device 3 according to the present embodiment is relatively low. Accordingly, the light source device 3 according to the present embodiment can reduce a leakage wave more than the light source device 1 of the first embodiment can do.

According to the light source device 3 of the present embodiment, since the reflecting plate 30A is provided in a direction perpendicular to the longitudinal direction of the supporting portion 10*c*, a leakage wave can be significantly reduced compared with the case where the reflecting plate 30 is disposed in the longitudinal direction of the supporting portion 10*c* like the light source device 1 of the first embodiment.

In addition, the conductive member 12 of the light source device 3 according to the present embodiment is not limited to being connected to the side surface of the reflecting plate 30A. For example, the conductive member 12 may be routed for connection such that the end of the conductive member 12 is connected to a side (back side) of the reflecting plate 30A which is opposite to a side of the reflecting plate 30A facing the light-emitting portion 10*a*. That is, a portion of the conductive member 12 connected to the reflecting plate 30A may be arbitrarily set at a position where light is not blocked.

Fifth Embodiment

Figure 9:
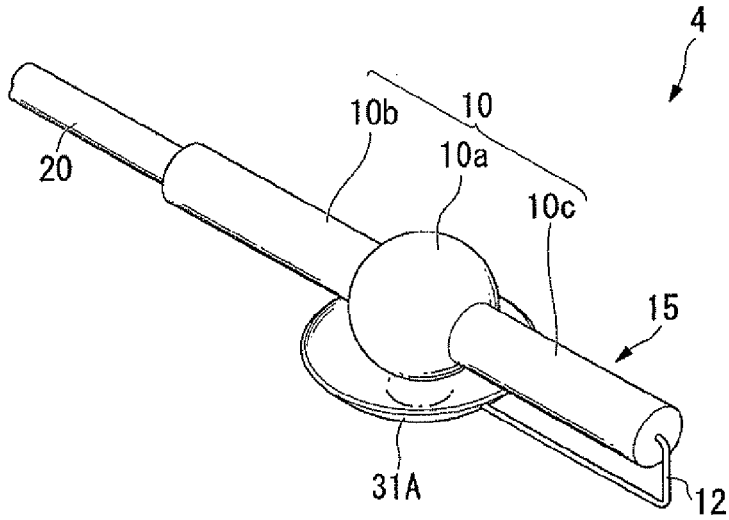
FIG. 9 is a perspective view showing the schematic configuration of a light source device according to a fifth embodiment.

Next, a light source device according to a fifth embodiment of the invention will be described with reference to FIG. 9. FIG. 9 is a perspective view showing the schematic configuration of a light source device 4 and corresponds to FIG. 6A. The light source device 4 according to the present embodiment is different from the light source device 3 described in the fourth embodiment in that a reflecting plate 31A has a saucer shape. The other points are the same as those in the fourth embodiment. Accordingly, the same components as in FIG. 6A are denoted by the same reference numerals, and a detailed explanation thereof will not be repeated.

As shown in FIG. 9, in the light source device 4, the reflecting plate 31A has a saucer shape instead of the disk-like shape unlike the light source device 3 of the fourth embodiment.

According to the light source device 4 of the present embodiment, since the reflecting plate 31A has a saucer shape, light emitted from the light-emitting portion 10*a* can be condensed and reflected. As a result, high-brightness emission close to a point light source can be realized since light is condensed.

Sixth Embodiment

Figure 10:
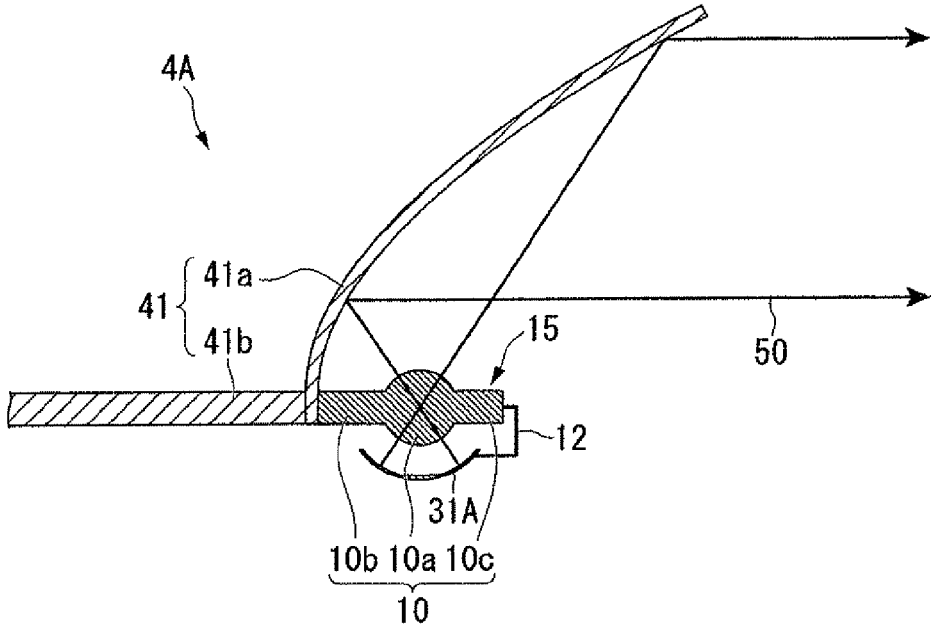
FIG. 10 is a sectional view showing the schematic configuration of a light source device according to a sixth embodiment.

Next, a light source device according to a sixth embodiment of the invention will be described with reference to FIG. 10. FIG. 10 is a view showing the sectional configuration of a light source device 4A obtained by providing a reflector 41 in the light source device 4 and corresponds to FIG. 5. The light source device 4A according to the present embodiment is different from the light source device 4 described in the fifth embodiment in that the reflector 41 is provided. The other points are the same as those in the fourth embodiment. Accordingly, the same components as in FIG. 9 are denoted by the same reference numerals, and a detailed explanation thereof will not be repeated.

As shown in FIG. 10, the light source device 4A is formed by providing the reflector 41, which reflects light reflected from the reflecting plate 31A, in the light source device 4 of the fifth embodiment. The reflector 41 includes an insertion portion 41*b*, into which the microwave excitation lamp 15 is inserted, and a semi-parabolic reflecting portion 41*a*, which has a parabolic reflecting surface that spreads from the insertion portion 40*b*. The reflecting portion 41*a* is provided to be positioned at a side (only one side) opposite the reflecting plate 31A with the microwave excitation lamp 15 interposed therebetween.

According to the light source device 4A of the present embodiment, the semi-parabolic reflecting portion 41*a* of the reflector 41 which reflects light reflected from the reflecting plate 31A is provided to be positioned at only one side. As a result, light emitted from the light-emitting portion 10*a* and light reflected from the reflecting plate 31A can be efficiently emitted in the approximately fixed direction without being blocked.

Figure 11:
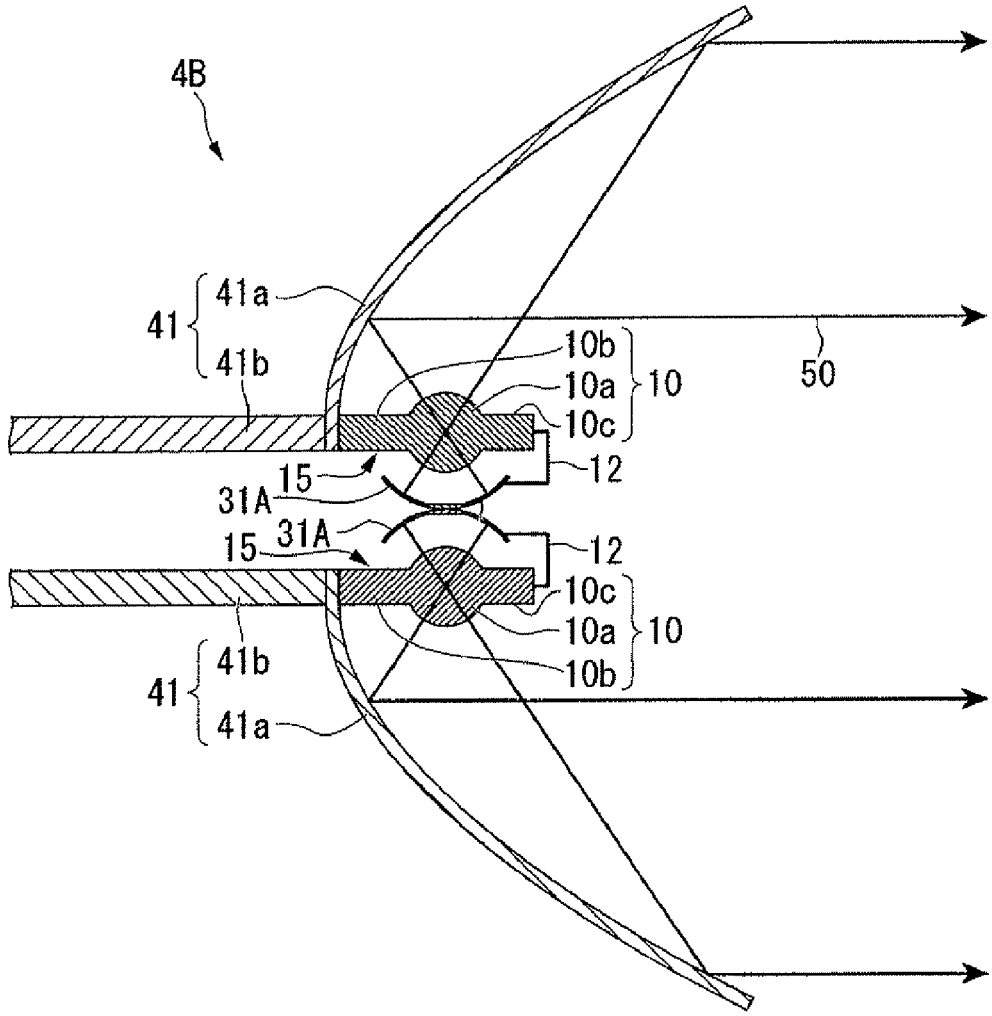
FIG. 11 is a sectional view showing the schematic configuration in a modification of the light source device according to the sixth embodiment.

In addition, a structure including the two light source devices 4A may be considered. FIG. 11 is a view showing the sectional configuration of a light source device 4B obtained by disposing the two light source devices 4A opposite each other and corresponds to FIG. 10. The same components as in FIG. 10 are denoted by the same reference numerals, and a detailed explanation thereof will not be repeated.

As shown in FIG. 11, the light source device 4B has the two light source devices 4A of the sixth embodiment. In the light source device 4B, the two reflectors 41 are provided at opposite positions with the two reflecting plates 31A interposed therebetween. Thus, it is possible to obtain the light source device 4B which has the reflecting plates 31A of a plurality of lamps with one lamp volume.

In addition, although an example where quartz glass is used as a material of forming the light-emitting tube 10 has been illustrated, the light source device according to the embodiment of the invention is not limited to the example. For example, transparent ceramics or transparent sapphire may be used as a material of forming the light-emitting tube 10. In this case, the optical transmittance or thermal resistance of the light-emitting tube 10 can be improved.

In addition, although an example where tungsten is used as a material of forming the electrodes 11*a* and 11*b* has been illustrated, the light source device according to the embodiment of the invention is not limited to the example. For example, portions of the electrodes 11*a* and 11*b* disposed in the supporting portions 10*b* and 10*c* may be made to have foil shapes. In this case, a metal foil formed of molybdenum is preferably connected to the electrodes 11*a* and 11*b*. In this case, since it is possible to remove a difference between coefficients of thermal expansion of the electrodes 11*a* and 11*b* and quartz glass which is a material of the light-emitting tube 10, the airtightness can be maintained in the emission space K.

In addition, although the lengths L1 and L2 of the supporting portions of the light-emitting tube are approximately the same, the light source device according to the embodiment of the invention is not limited to this. For example, one of the lengths L1 and L2 of the supporting portions may be set to be shorter than the other one. In this case, it is preferable to set the length L2 of the supporting portion shorter. In this case, the inventor of the present embodiment expects that the luminous efficiency of the light source device 1 could be significantly improved because the current density of the light-emitting portion 10*a* is increased.

Moreover, in the light source device according to the embodiment of the invention, the electrodes 11*a* and 11*b* are inserted into the supporting portions 10*b* and 10*c*, respectively, and are disposed with a gap therebetween such that tips of the electrodes 11*a* and 11*b* are opposite each other in the emission space K of the light-emitting portion 10*a*. However, the invention is not limited thereto. For example, the electrodes 11*a* and 11*b* may be disposed such that the tips are connected by a coil-shaped connecting member.

Projector

Figure 12:
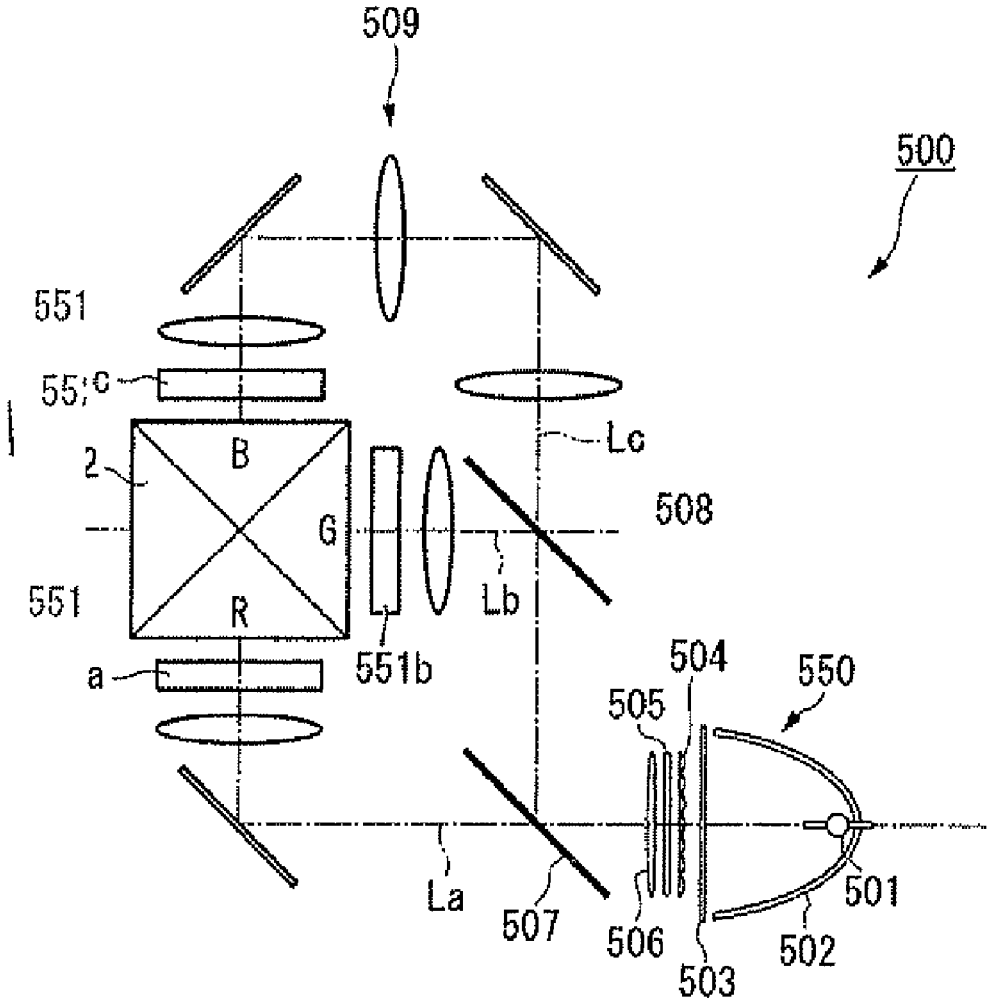
FIG. 12 is a view showing the schematic configuration of a projector according to another embodiment.

Next, a projector according to another embodiment of the invention will be described with reference to FIG. 12. As shown in FIG. 12, a projector 500 includes a light source device 550, liquid crystal light valves (image forming devices) 551*a*, 551*b*, and 551*c*, a cross dichroic prism 552, and a projection lens (projection device) 553. The light source device 550 is the light source device according to the embodiment of the invention and includes a microwave excitation lamp 501, a reflector 502, a filter 503, a lens array 504, a polarization conversion element 505, and a condenser lens 506. Light emitted from the light source device 550 is incident on the liquid crystal light valves 551*a* to 551*c* through dichroic mirrors 507 and 508, a relay optical system 509, and the like.

The dichroic mirrors 507 and 508 are formed by laminating a dielectric multilayer on a glass surface, for example. Accordingly, the dichroic mirrors 507 and 508 selectively reflect color light in a predetermined wavelength band and transmit color light in the other wavelength band. For example, red light La of light source beams emitted from the light source device 550 is transmitted through the dichroic mirror 507, and green light Lb and blue light Lc are reflected by the dichroic mirror 507. Moreover, of the green light Lb and the blue light Lc reflected by the dichroic mirror 507, the blue light Lc is transmitted through the dichroic mirror 508 and the green light Lb is reflected by the dichroic mirror 508.

The red light La transmitted through the dichroic mirror 507 is reflected by a reflecting mirror and is then incident on the liquid crystal light valve 551*a* for red light through a collimating lens. The green light Lb reflected by the dichroic mirror 508 is incident on the liquid crystal light valve 551*b* for green light through a collimating lens. The blue light Lc transmitted through the dichroic mirror 508 is incident on the liquid crystal light valve 551*c* for blue light through the relay optical system 509.

The cross dichroic prism 552 has a structure in which triangular prisms are bonded to each other was stuck. A mirror surface, from which the red light La is reflected and through which the green light Lb is transmitted, and a mirror surface, from which the blue light Lc is reflected and through which the green light Lb is transmitted, are formed on the inner surface so as to be perpendicular to each other. The red light La, the green light Lb, and the blue light Lc are selectively reflected by the mirror surfaces or selectively transmitted through the mirror surfaces and are then emitted to the same side. Then, three color light beams are superimposed to become mixed light. The mixed light is projected onto a screen 560 in an enlarged manner by the projector lens 553. As a result, a color display image is obtained.

Since the projector 500 includes the light source device 550 which is the light source device according to the embodiment of the invention, the light source device 550 can be made small. Accordingly, the projector 500 can be made small. In addition, since the use efficiency of light is high in the light source device 550, the power consumption of the projector 500 is low. In addition, since a leakage wave can be reduced by the light source device 550, the projector 500 which is very reliable can be obtained.

In addition, although an example where a transmissive liquid crystal light valve is used as an image forming device has been illustrated in the above embodiment, a reflective liquid crystal light valve may also be used. In this case, the above-described optical system is also appropriately changed to an optical system which is suitable for the reflective liquid crystal light valve. In addition, it is also possible to use an image forming device other than the liquid crystal light valve. For example, an image forming device other than the liquid crystal light valve, such as a digital mirror device, may be used.

What is claimed is:

1. A light source device comprising:

a microwave power source which outputs a microwave;

a light-emitting tube with an emission space where a light-emitting material, which emits light by input of the microwave, is filled;

a first electrode which is provided at one side of the light-emitting tube and is electrically connected to the microwave power source;

a second electrode which is provided at the other side of the light-emitting tube, the emission space being interposed between the first and second electrodes; and a reflecting plate which is electrically connected to the second electrode and which reflects the microwave such that an antinode of the amplitude of a standing wave of a high-frequency current is positioned in the emission space by making the microwave resonate.

2. The light source device according to claim 1, wherein the reflecting plate is connected to an end of the second electrode which is opposite to a side of the second electrode provided in the light-emitting tube.

3. The light source device according to claim 1, wherein the reflecting plate is disposed in direction perpendicular to the longitudinal direction of the second electrode.

4. The light source device according to claim 1, wherein the reflecting plate has a disk-like shape.

5. The light source device according to claim 1, wherein the reflecting plate has a saucer shape.

6. The light source device according to claim 1, wherein the reflecting plate is formed of metal.

7. The light source device according to claim 1, further comprising:

a reflector with a reflecting surface which reflects light reflected from the reflecting plate.

8. A projector comprising the light source device according to claim 1.

* * * * *